United States Patent [19]

Montferme et al.

[11] 4,444,423

[45] Apr. 24, 1984

[54] VARIABLE CONFIGURATION HEAD FOR SEIZING AND HANDLING OBJECTS

[75] Inventors: Daniel Montferme, Vernouillet; Didier Lemaire, Cherisy-Vernouillet, both of France

[73] Assignee: E. P. Remy et Cie, Dreux, France

[21] Appl. No.: 314,406

[22] Filed: Oct. 23, 1981

[30] Foreign Application Priority Data

Nov. 10, 1980 [FR] France ..... 80 23991

[51] Int. Cl.[3] ..... B65G 47/26

[52] U.S. Cl. ..... 294/87 R; 198/434; 198/486; 294/65; 414/416

[58] Field of Search ..... 294/63 R, 64 R, 65, 294/86 R, 87 R, 87 A, 88; 53/247, 543, 544; 198/432, 434, 486; 414/416, 783

[56] References Cited

U.S. PATENT DOCUMENTS 2,712,405 7/1955 Rockcastle ..... 414/416 X 3,230,001 1/1966 Hirt ..... 294/64 R 3,860,280 1/1975 Karlsson ..... 294/65 X 3,929,234 12/1975 Warren ..... 414/416 X

FOREIGN PATENT DOCUMENTS 52-913373 10/1977 Japan .

*Primary Examiner*—Johnny D. Cherry

*Attorney, Agent, or Firm*—Kenyon & Kenyon

[57] ABSTRACT

The invention relates to a variable-configuration head for seizing and handling objects, which head comprises a frame from which are suspended supports for seizing members through the medium of three links swivelled both to the supports and to the frame, the supports being geometrically equivalent to two identical articulated parallelograms having opposite angles at one common vertex, so as to allow the supports to be joined together transversely or longitudinally to modify the configuration of the group of objects held by the seizing members.

4 Claims, 3 Drawing Figures

VARIABLE CONFIGURATION HEAD FOR SEIZING AND HANDLING OBJECTS

The present invention has essentially for a subject matter a variable-configuration head for seizing and handling objects, such as for example bottles, flasks or the like.

There have already been proposed gripping heads which are made up essentially of a frame from which are suspended members for seizing for example bottles. Such heads may be suspended from a conveyor and may seize bottles for example from a board box and then convey them to a desired location and lay them down by releasing them onto for example a conveyor, it being understood that the aforesaid operations in the reverse order allowing bottles to be encased are perfectly possible.

Now the hitherto known gripping heads did not allow the group of bottles to be modified after they had been seized so as to effect a new given grouping of the bottles for the purpose of subjecting them to a subsequent treatment. In other words, the grouping of the bottles seized and subsequently released was the same, which may be perfectly suitable in some cases, but which is insufficient in others, for example in case it is desired to seize bottles in a board box containing several rows of bottles, and thereafter regroup the bottles into a minimum of rows, thus considerably facilitating the treatment of the bottles, for example their filling, plugging, labelling, etc.

Such therefore is the problem solved by the present invention which provides a new articulated gripping head which is particularly flexible in use and allows the number of rows of bottles seized and thereafter released to be very simply modified.

To this end, the invention has for a subject matter a variable-configuration head for seizing and handling objects such as for example bottles or the like, and of the type comprising essentially a frame from which are suspended seizing members, characterized in that the said seizing members are assembled to at least two movable supports swivelled to the said frame and juxtaposable both in the transverse and longitudinal directions to allow the configuration of the group of objects held by the head to be modified.

This modification of the configuration of the group of bottles is obtained by the fact that the two aforesaid supports are geometrically equivalent to two identical articulated parallelograms or parallelogrammatic linkage systems having opposite angles at one common vertex.

According to another characterizing feature of the invention, there are provided three links swivelled to the two aforesaid supports as well as to the frame which comprises means of control of the said links.

The said control means are constituted by a movable rack and pinion mechanism for driving the said links in rotation.

According to a preferred form of embodiment, the aforesaid three links consist, on the one hand, of two links each swivelled to a said support, respectively, and on the other hand, of a third or intermediate link swivelled to both supports.

More precisely, the head frame is provided with a fluid-operated actuator for driving in translation the toothed rack which in turn drives in rotation three pinions which in turn drive in rotation the three links, respectively.

According to still another characterizing feature of the invention, the aforesaid three pinions are each assembled to an idler swivel pin mounted on the frame and the free end of which is connected to the link associated therewith.

Furthermore, the frame and the supports of the seizing members are provided respectively with stops for limiting the travel of the supports with respect to the frame.

The invention is also directed to a conveyor equipped with one or several heads meeting the aforementioned characterizing features.

Other characterizing features and advantages of the invention will appear more clearly from the following detailed description with reference to the appended drawings given solely by way of example and wherein.

Figure 2:
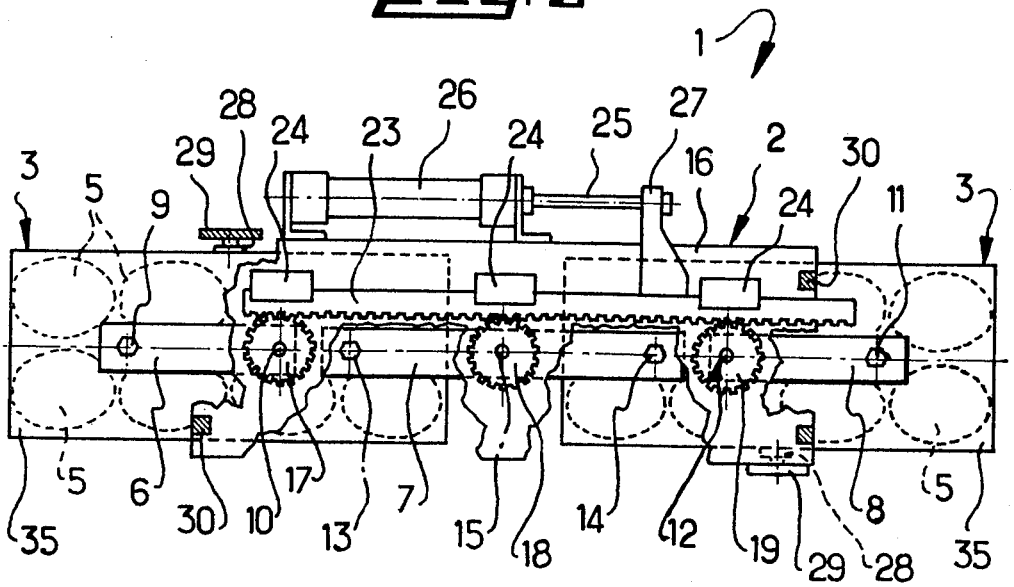
FIG. 2 is a sectional view substantially upon II—II of FIG. 1.
Figure 3:
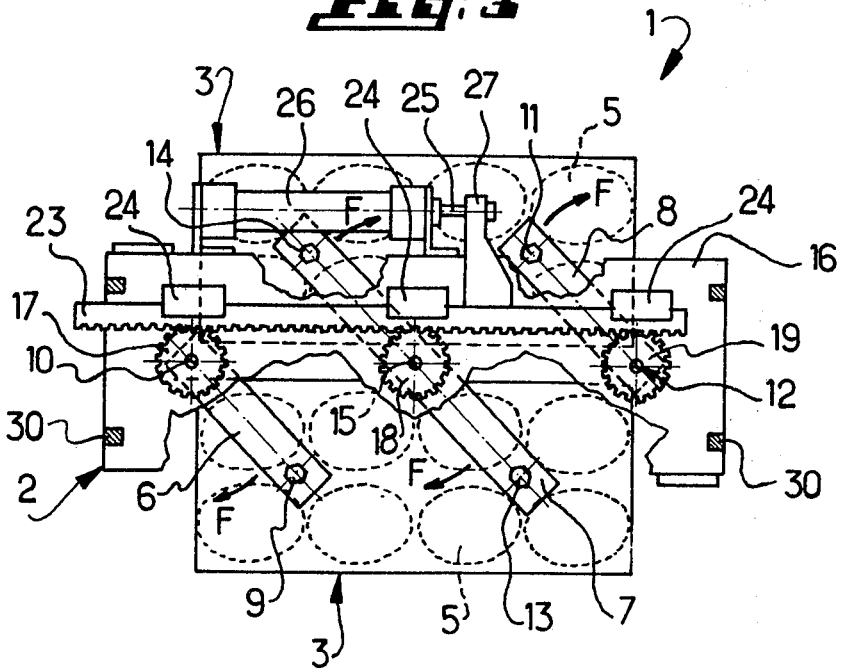

FIG. 3 also is a sectional view of the head seen in FIG. 2 but showing the latter in gathered-up position wherein the number of rows of bottles is maximum, as is for example the case with bottles grouped in a case, board box or the like.

According to an example of embodiment and referring to the appended drawings, a gripping head 1 according to the invention comprises essentially a frame 2 from which are suspended two movable supports 3 which carry members 4 for seizing bottles or flasks 5. According to the example of embodiment illustrated, each support 3 can seize two rows of four bottles each, it being understood that any desired number of rows and of bottles supported by each support 3 may be provided without departing from the scope of the invention.

Referring more particularly to FIG. 3, it is seen that the two supports 3 are swivelled to one another and to the frame 2 through the medium of three links 6, 7 and 8. More precisely, the link 6 is swivelled at 9 to a support 3 and at 10 to the frame 2, the link 8 is swivelled at 11 to the other support 3 and at 12 to the frame 2, and the intermediate link 7, swivelled at 13 to one of the supports 3 and at 14 to the other support 3, has a swivelling point or fulcrum 15 on the frame 2. As seen clearly in the Figures, the pin 15 by which the link 7 is swivelled or pivotally connected to the frame 2 is provided at the middle of the said link.

Thus, the two supports 3 are geometrically equivalent to two articulated parallelograms or parallelogrammatic linkage systems 14, 11, 12, 15, on the one hand, and 15, 13, 9, 10, on the other hand, which articulated parallelograms are substantially identical and have opposite angles at one vertex 15.

The frame 2 according to the example of embodiment illustrated comprises a supporting plate 16 from which are suspended the supports 3 of the seizing members 4, and through which are mounted three idler or freely rotatable pinions or the like 17, 18 and 19 adapted to drive in rotation, respectively and simultaneously, the links 6, 7 and 8. More precisely and as seen clearly in FIG. 1, each pinion 17, 18 and 19 is assembled to a pivot pin 20 mounted in a bearing or the like 21 and the free end 22 of which is connected to the link associated therewith.

The three pinions 17, 18 and 19 mesh with a toothed rack 23 slidingly movable in guide means 24 secured to the frame 2. The toothed rack 23 according to one example of embodiment is driven in translation by a fluid-operated actuator 26 secured to the frame 2 and the rod 25 of which is connected to the toothed rack 23 through the medium of an operating arm or lever 27 as appears clearly in FIGS. 2 and 3.

Figure 1:
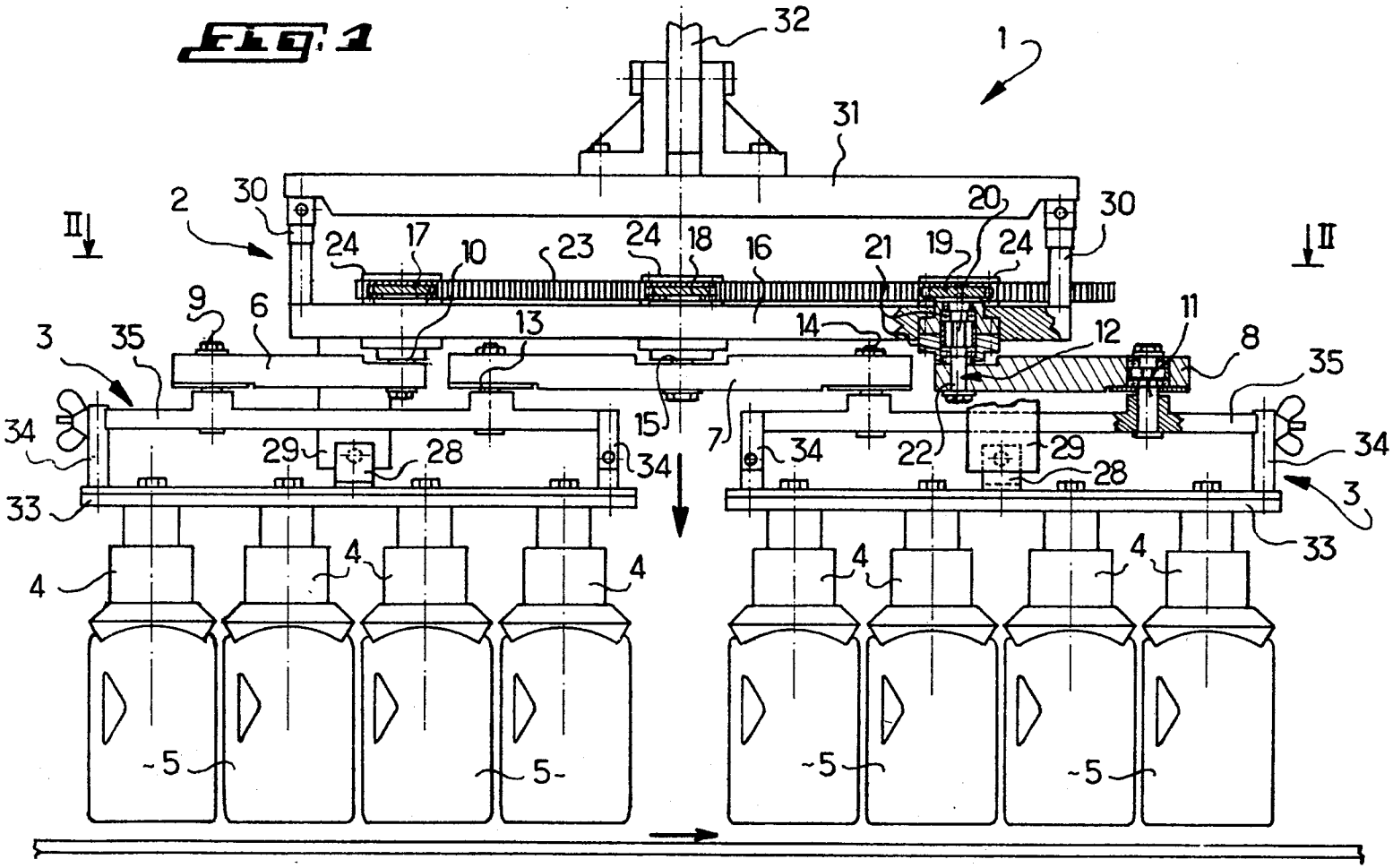
FIG. 1 is an elevational, partially sectional view of the head in spread-out position wherein the number of rows of bottles is reduced to a minimum.

For the supports 3 of the seizing members 4 to be relatively movable with respect to the frame 2, the pivot pins 10, 15 and 12 are respectively jointly movable in rotation with the pinions 17, 18 and 19 and with the links 6, 7 and 8, whereas the pivot pins 9, 13, 14 and 11 of the links 6, 7 and 8 on the supports 3 are free in rotation and for example simply constituted each by a small, appropriately retained pivot pin connecting the link to its associated support 3, as can be clearly seen in section in FIG. 1 (see pivot pin 11).

At 28 are shown stops mounted on the supports 3, and at 29 are shown stops mounted on the frame 2 and more particularly on the supporting plate 16. The stops 28 and 29 are intended to limit the travel of the supports 3 with respect to the frame 2.

Furthermore, the plate 16 of the frame 2 is removably connected through the medium of cross-members 30 to another plate 31 on which is mounted a rod or the like 32 from which is suspended the whole of the head 1 and can be displaced, the rod 32 being for example and as known per se connected to a conveyor (not shown). Also, each support 3 comprises a plate 33 supporting the seizing members 4, which plate also is removably connected by cross-members 34 to another plate or the like 35 swivelled to the links, as described previously.

The operation of the gripping head 1 directly follows from the foregoing description and will be briefly described hereafter.

It will be assumed that the starting position of the head 1 is the one seen in FIG. 3 in which the two supports 3 are transversely joined to one another. This position corresponds to the position of uncasing of the bottles from one or several board boxes or cases containing, in the example illustrated, sixteen bottles distributed into four rows of four bottles each.

Once the bottles are seized from the board box, the actuator 26 is put in action to simultaneously drive in rotation the three pinions 17, 18 and 19 and consequently the three links 6, 7 and 8 which rotate simultaneously according to the arrow F seen in FIG. 3.

Thus, the articulated parallelograms 14, 11, 12, 15 and 15, 13, 9 and 10 are deformed simultaneously about the swivel point 15, thus causing a displacement in the opposite direction of the supports 3 which slightly move from one another to finally assume the longitudinally joined position seen in FIG. 2.

Thus, the four rows of bottles previously seized by the members 4 are transformed into two rows of bottles which may thereafter be released at any station or even onto a conveyor which will convey the bottles in a group of two rows, which constitutes a suitable arrangement for subjecting the bottles to subsequent treatments such as for example their filling, plugging, labelling, and then their boxing.

Of course, the present invention is by no means limited to the form of embodiment described and illustrated which has been given by way of example only.

Thus, for example, any number of seizing members connected to the supports may be used depending on the group of bottles to be seized and treated thereafter. Likewise, use can be made of a head frame and of seizing member supports of any structure, since this has no particular influence on the system of articulation of the supports according to the invention.

The latter therefore comprises all technical equivalents to the means described as well as their combinations if the latter are carried out according to the gist of the invention and used within the scope of the protection claimed.

What is claimed is:

1. A variable-configuration head for seizing and handling an array of objects, the head including a frame, a plurality of links, each link being connected to the frame for swiveling about a respective point fixed in relation to the frame, and a pair of seizing member supports, each support carrying at least one row of seizing members and being swivelled from at least two links, wherein the improvement comprises:

the swivel points of the links with respect to the frame and the swivel points of the seizing member supports with respect to the links together define corners of two identical articulated parallelograms having opposite angles located at a common vertex, such that the seizing member supports can be swivelled about the frame from a first position in which the supports are aligned in one direction to a second position in which the supports are aligned transversely to said one direction.

2. A variable-configuration head according to claim 1 wherein said plurality of links comprise three links, and the head further comprises:

three pinions, each pinion being connected to a respective one of the links for rotating the link about its swivel point with respect to the frame;

a fluid-operated actuator fixed to the frame; and a toothed rack meshing with the three pinions and displaceable by the actuator to drive the pinions for rotating the links.

3. A varible-configuration head according to claim 2 wherein one of said three links is swivelled at first and second spaced apart points respectively to the two seizing member supports and at a third point, intermediate said first and second points, to the frame, and each of the other links is swivelled at a first point to a respective one of the seizing member supports and at a second point to the frame.

4. A variable-configuration head according to claim 1, the head further comprising stop members fixed respectively to the frame and to the pair of seizing member supports for limiting travel of the supports with respect to the frame to between said first and second positions.

* * * * *